United States Patent [19]

Streubel

[11] 4,037,647

[45] July 26, 1977

[54] STRAND GUIDE FRAMEWORK FOR SUPPORTING A PARTIALLY SOLIDIFIED STRAND IN A CONTINUOUS CASTING INSTALLATION

[75] Inventor: Hans Streubel, Dusseldorf, Germany

[73] Assignee: Schloemann-Siemag Aktiengesellschaft, Dusseldorf, Germany

[21] Appl. No.: 530,522

[22] Filed: Dec. 9, 1974

[30] Foreign Application Priority Data

Dec. 21, 1973 Germany ..... 2363841

[51] Int. Cl.[2] ..... B22D 11/128; B22D 11/124

[52] U.S. Cl. ..... 164/282; 164/82; 164/283 S

[58] Field of Search ..... 164/82, 277, 282, 283 S; 72/241, 243, 247

[56] References Cited

U.S. PATENT DOCUMENTS

| | | | |
|---|---|---|---|
| 1,522,473 | 1/1925 | Chartener | 72/243 |
| 1,953,190 | 4/1934 | Paterson | 72/243 |
| 2,909,088 | 10/1959 | Volkhausen | 72/241 |
| 3,024,679 | 3/1962 | Fox | 72/243 |
| 3,339,623 | 9/1967 | Rys et al. | 164/283 S |
| 3,538,980 | 11/1970 | Gallucci | 164/282 |
| 3,837,391 | 9/1974 | Rossi | 164/282 |

*Primary Examiner*—Ronald J. Shore
*Assistant Examiner*—Gus T. Hampilos
*Attorney, Agent, or Firm*—Werner W. Kleeman

[57] ABSTRACT

A strand guide framework for supporting a partially solidified strand in a continuous casting installation consisting of at least two guide roller pairs which follow one another in the direction of travel of the strand, the guide roller pairs being provided with supporting rolls, the lengthwise axes of which are arranged with the lengthwise axes of the guide rolls approximately in a plane located transverse to the axis of travel of the strand and wherein the framework is equipped with secondary cooling means or devices. According to the invention the support or supporting rollers are each provided with two support collars for the guide rollers, and the diameter of the support rollers determined by the permissible mechanical loading and the space required for the secondary cooling device determines the minimum spacing of the successive guide rollers.

8 Claims, 7 Drawing Figures

STRAND GUIDE FRAMEWORK FOR SUPPORTING A PARTIALLY SOLIDIFIED STRAND IN A CONTINUOUS CASTING INSTALLATION

BACKGROUND OF THE INVENTION

The present invention relates to a new and improved construction of roller apron framework or strand guide framework for supporting a partially solidified strand in a continuous casting installation, comprising at least two guide roller pairs which follow one another in the direction of travel of the strand, the guide roller pairs being provided with supporting rollers, the lengthwise axes of the supporting rollers being arranged with respect to the lengthwise axes of the guide rollers approximately in a plane located transversely with respect to the axis of the direction of travel of the strand and wherein the framework is equipped with secondary cooling means or devices.

The guide rollers of continuous casting installations during each rotation are exposed to a high mechanical alternating load owing to the ferrostatic pressure which acts upon the shell or skin of the strand and, in the case of slab continuous casting installations, can amount to more than 100 tons per roller. An additional loading of the rollers is brought about owing to the shock-like temperature increase of the roller surface during each contact with the hot strand. This mechanical and thermal loading requires, depending upon the strength of the roller material, a certain roller diameter from which, while taking into account the secondary cooling device, there can be derived a certain roller spacing and thus the size of the unsupported surfaces. The alternate dependency between the permissible roller loading by the ferrostatic pressure, the strand width, the frozen shell thickness, the roller diameter and the spacing of successive rollers, in the case of large cast shapes limits the casting speed since there must be avoided damaging bulging and breakouts. Strands with widths of, for instance, 2.5 to 3 meters can not be rationally cast with the aforementioned devices.

In order to be able to maintain a small roller spacing between two successive guide rollers, it is known to the art to construct such rollers as multiple-part components and to support the same at a number of locations by bearings. Such roller bearings which are arranged directly over the hot strand are, however, exposed to the thermal radiation of the strand and in the case of insufficient strand cooling at the region of the bearings are strongly endangered owing to overheating and seizing.

Furthermore, it is known to the art in straightening drivers of curved continuous casting installations to provide the lower rollers at the tangent point and the reaction rollers which take-up the straightening forces with supporting or support rollers. Such support rollers which are arranged individually in straightening machines can be freely selected as to their diameter because the guide rollers neighboring the straightening rollers and reaction rollers are not equipped with support rollers.

There is also known to the art a strand guide arrangement or roller apron for continuous casting installations in which the driving rollers are supported by equally strong supporting rollers continuously at their spherical portions or crowns. For such roller arrangement the drive rollers and the support rollers which are in contact therewith are equally markedly bent-through under the action of the ferrostatic pressure owing to the same loading. The bending-through and mechanical loads or stresses in the drive rollers which are located in contact with the strand, with this arrangement, only can be reduced a relatively small amount. Since such drive rollers are additionally exposed to the alternating thermal loads, the entire or total loading of the drive rollers is considerably greater than that of the support rollers. An increase of the drive roller diameter automatically brings about a larger undesired roller spacing.

SUMMARY OF THE INVENTION

It is a primary object of the present invention to provide a strand guide framework with reduced roller spacing of the guide rollers and/or reduction of the mechanical loads of the guide rollers as well as an improved relationship of the space for the secondary cooling.

Furthermore it is an object of the invention to provide the ability to cast strands exceeding 2 meters width with acceptable roller loads.

Now in order to implement these and still further objects of the invention, which will become more readily apparent as the description proceeds, the invention contemplates that the support rollers are provided with two support collars for the guide rollers, wherein the diameter of the support rollers which determines the permissible mechanical loads and the space required for the secondary cooling means determines the minimum spacing of the successive guide rollers.

With this apparatus the roller spacing for continuous casting installations can be reduced and thus the support of the strand shell or skin improved, allowing for greater casting speeds. The free cooling surface at the strand resulting between two guide rollers can be accommodated within certain limits to the provided form of the spray pattern due to the selection of the diameter ratio between the support rollers and the guide rollers. Additionally, the rollers bearing against the hot strand are considerably less loaded with regard to mechanical stresses or loads and bending-through than the support rollers themselves. Consequently, there results an increase in their longevity. Because the main support force for the support rollers and the alternating thermal load is taken up by the guide rollers it is possible to accommodate the materials to such specific loads. Such a strand guide framework also renders possible the casting of strands having a width exceeding 2 meters.

Advantageous relationships with respect to the mechanical loads and the bending-through of the guide rollers and support rollers, the free cooling surface at the strand, the required minimum intermediate space for the cooling device and the minimum spacing of successive guide rollers, according to a further construction of the invention, can be obtained if the supporting diameter of the support rollers approximately corresponds to the same diameter up to 1.6-fold diameter of the guide rollers.

The bearings of the guide rollers are advantageously floatingly arranged with respect to the bearings of the support rollers transverse to the strand direction of travel. In this way there is achieved a direct force flow from the guide rollers to the support collars, whereby loading of the guide roller bearings transverse to the strand direction of travel is avoided.

A further improvement resides in the features that the support collars are dished or arched. In this way there is avoided the presence of edge compressions owing to the different bending lines of the support rollers and guide rollers. Due to the dishing or arching, as above-mentioned, there is achieved a compensation of the bending angle through a displacement of the supporting surfaces to the support collars and corresponding to the momentary load. In the case of wide slabs there is additionally attained, owing to the restoring moment, an accommodation of the contact surface of the guide rollers at the dished or arched support collars.

The magnitude of the maximum bending loads of the guide rollers occurring at the region of the support collars and the center of the rollers together with other influencing magnitudes are determined by the width of the slabs and the supporting distance. The distance of the supporting collars can be therefore advantageously fixed in such a way that the maximum bending moment brought about at the region of the supporting collars by the widest slab corresponds to the maximum bending moment generated by a narrow slab at the center of the roller.

The axes of oppositely situated guide rollers can be arranged at one plane which is shifted by a distance from the common plane of the axes of the support rollers opposite to the direction of travel of the strand, wherein such spacing corresponds to the tangent 2° multiplied by the radius of the guide roller. In this way, owing to the friction and strand irregularities in the direction of travel of the strand the force components acting upon the guide rollers are extensively taken-up by the support collars.

The swelling of the support rollers under load and thus the displacement of the guide rollers can be maintained the same by accommodating the moment of inertia of the support rollers to the ferrostatic intensity. Since the support collar-diameter in this case need not be changed it is possible for the spacing of the bearing of successive support roller pairs, which spacing is measured transverse to the direction of travel of the strand, to remain the same over a certain range.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
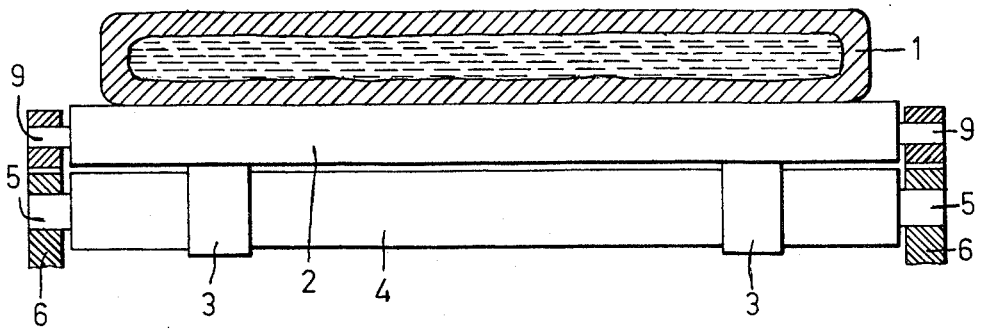
FIG. 1 illustrates a strand guide unit consisting of a guide roller and a support roller.
Figure 2:
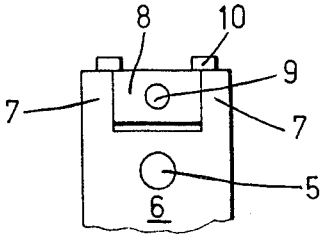
FIG. 2 illustrates the mounting or bearing arrangement of the guide unit according to FIG. 1.

Describing now the drawings in a continuous casting installation a cast strand 1 having a liquid core is supported by successively arranged guide rollers 2. These guide rollers 2 in turn are supported at their spherical portions by means of support rollers 4, each equipped with two lateral support collars 3. The support rollers 4 are received by means of their journals 5 in a bearing or mounting arrangement 6 which is secured to a not particularly illustrated structure. The bearing arrangement 6 is provided with side cheeks or plates 7, between which there are displaceably guided, transverse to the guided strand surface, bearing means 8 for the journals 9 of the guide rollers 2. For the upward limiting of the displacement path there are mounted at the side cheeks or plates 7 the stops 10.

Figure 3:
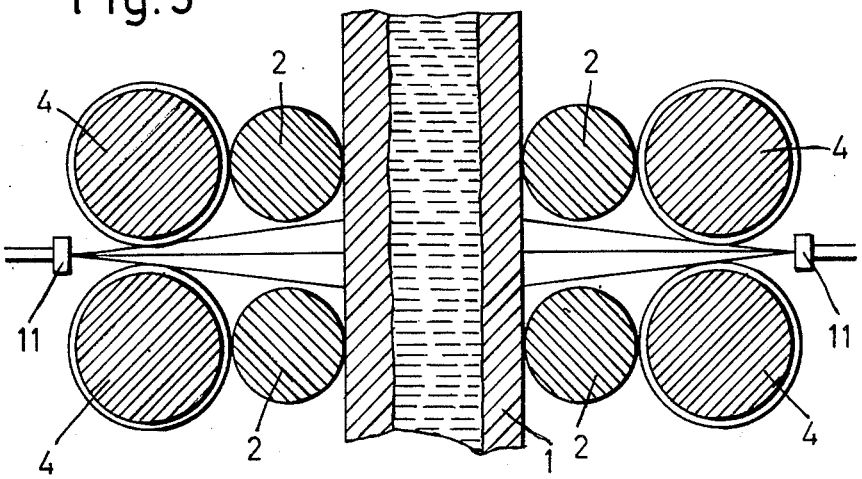
FIG. 3 illustrates the succesive arrangement of a number of strand guide units.

FIG. 3 shows the arrangement of the guide units consisting of a respective guide roller 2 and a support roller 4. Between the guide units there are directed spray nozzles 11 at the unsupported surfaces of the strand 1. The minimum roller spacing 69 (FIG. 6) of the guide rollers is thus determined by the diameter of the support or supporting rollers 4 and the necessary minimum space requirement of the spray nozzles 11.

Figure 4:
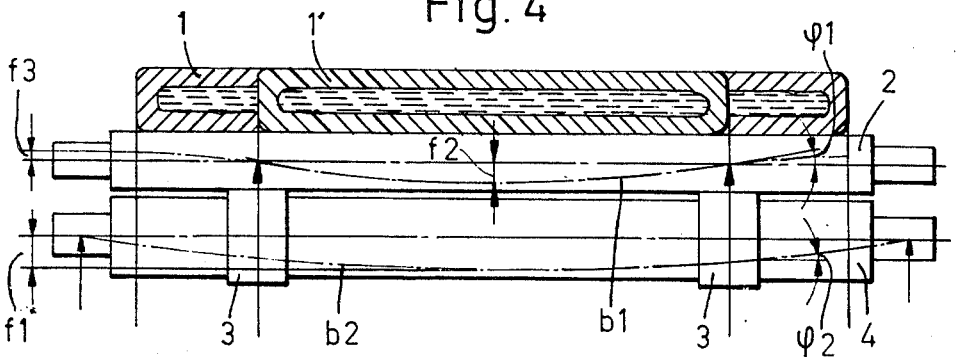
FIG. 4 illustrates the bending-through of the guide- and support rollers.

In FIG. 4 there are illustrated in an exaggerated manner the bending through of a guide roller 2 and a support roller 4 by the lines *b*1 and *b*2. The bending lines *b*1 and *b*2 form at the region of the support collars 3 with the horizontal the bending angles 41 and 42. A wide slab 1 produces externally of the support collars 3 a restoring moment in the guide roller, so that the bending line *b*1 extends between the legs of the angle 41, as shown.

Figure 5:
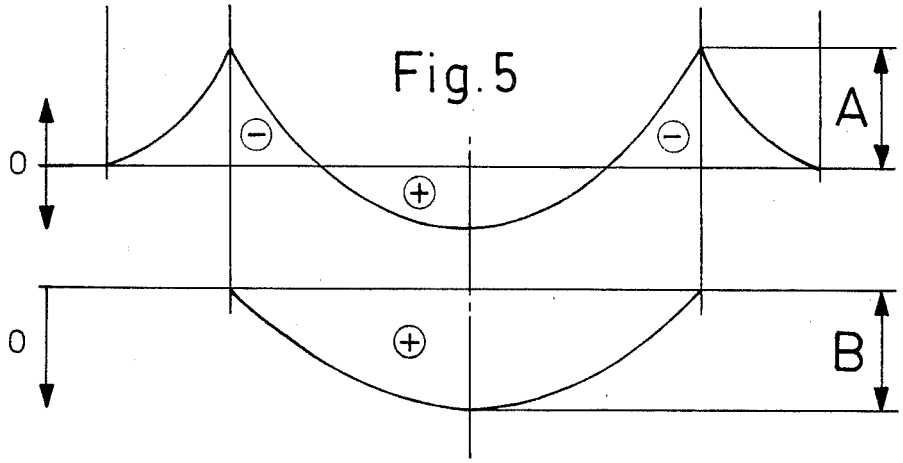
FIG. 5 illustrates the moment areas of a support roller for two conditions of loading.

This condition of loading has been illustrated in the upper moment area of FIG. 5. The maximum bending moment Mb max A in this case occurs at the region of the support collars 3. The lower bending area shows the loading of a guide roller 2 by a narrow slab 1' corresponding to the support width. Hence, the maximum bending moment Mb max B occurs at the center of the guide roller 2. A favorable loading for the guide roller is realized when Mb max A equals Mb max B.

In the case of a guide roller 2 with a diameter of 200 millimeters and a support roller 4 with a supporting diameter of 265 millimeters there were ascertained with a spacing of the bearing center of a roller of 3360 millimeters and a spacing of the support collar centers of 1640 millimeters the following bending through of the rollers. The central spacing of successive guide rollers 2 in this case was calculated at 310 millimeters.

| | | |
|---|---|---|
| Slab width | 3000 millimeters | 2000 millimeters |
| Max. bending through of the guide rollers | $f_2 + f_3 =$ 0.31 millimeters | 0.57 millimeters |
| Bending through of the support rollers at the support collars | $f_1 =$ 2.27 millimeters | 1.46 millimeters |

By virtue of the maximum bending loads of about 350 Kp/ cm² thus occurring at the guide rollers 2 there is insured for a greater longevity than in the case of the nowadays conventional upsupported rollers.

This example shows that the relationship of the bending through of the guide rollers 2 to the bending through of the support rollers 4 at the support collars 3 with the given spacing of the support collar centers is dependent upon the slab width. The ratio amounts to 0.31:2.27 = 1:7.3 for a 3000 millimeter slab width and for a 2000 millimeter slab width such ratio amounts to 0.57:1.46 = 1.2.56. As the smallest most advantageous ratio of the bending through of the guide rollers to the bending through of the support rollers at the support collars 3 there is to be evaluated a ratio of about 1:2.

Figure 6:
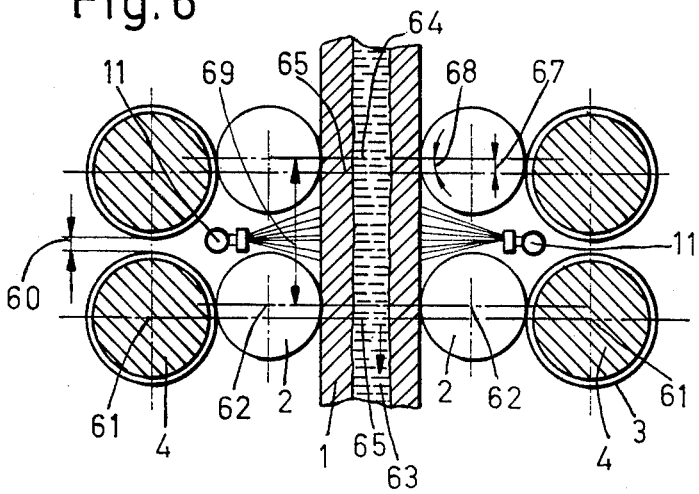
FIG. 6 illustrates another exemplary embodiment of the invention in sectional view.

In the exemplary embodiment illustrated in FIG. 6 the lengthwise axes 61 of the support rollers 4 and the lengthwise axes 62 of the guide rollers 2 are only approximately arranged in a plane located transverse to the direction of travel 63 of the strand. In order to be able to advantageously take-up forces acting in the direction of travel 63 of the strand at the guide rollers 2 the axes 62 of oppositely situated guide rollers 2 are arranged in a plane 64 and the support rollers 4 in a plane 65. The plane 64 is offset relative to the plane 65 opposite to the strand direction of travel 63, whereby its greatest spacing 67 corresponds to the tangent of an angle 68 of 2° multiplied by the radius of the guide roller 2.

Between the guide rollers 2 there are arranged spray nozzles 11 for cooling the now partially solidified strand 1. The support rollers, according to this example, are selected as concerns their diameter such that the support collars 3 of successively following rollers form a gap 60 of only a few millimeters size. Through the selection of a diameter ratio between the support rollers 4 and the guide rollers 2 of 1.4 there remains sufficient space for the spray nozzles 11 of the secondary cooling device. The minimum spacing 69 of successive guide rollers 2 is thus only determined by the diameter of the support rollers 4, which in turn again is determined by the permissible mechanical load and bending through.

Figure 7:
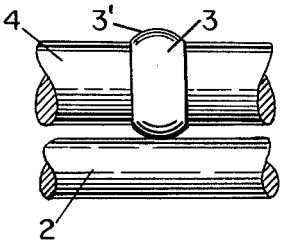
FIG. 7 illustrates in fragmentary view one of the dished support collars of a support roller.

Finally, in FIG. 7 there is shown a modified construction of a support roller 4 having a support collar 3 which is dished or arched, as generally indicated by reference character 3'.

The field of application of such type strand guide framework encompasses also driving-, bending- and straightening units.

While there is shown and descibed present preferred embodiments of the invention, it is to be distinctly understood that the invention is not limited thereto, but may be variously embodied and practiced within the scope of the following claims. ACCORDINGLY,

I claim:

1. A strand guide framework for supporting a partially solidified strand in a continuous casting installation comprising at least two guide roller pairs which successively follow one another in the direction of travel of the strand, support rollers supporting said guide rollers, the lengthwise axes of the support rollers being arranged with respect to the lengthwise axes of the guide rollers approximately in a plane located transverse to the direction of travel of the strand, said framework being equipped with secondary cooling means, each of the support rollers being provided with means cooperating with an associated guide roller and positioned at spaced predetermined points intermediate the ends of each support roller for providing restoring bending moments in said associated guide roller outwardly of each of said predetermined points, said cooperating means comprising only two support collars on each of said support rollers, the minimum spacing between the guide rollers is determined by the diameter of the support rollers and the space required for the secondary cooling means, and wherein the support collars are mounted such that the bending of the guide rollers is less than the bending of the support rollers.

2. The strand guide framework as defined in claim 1, further including bearing means for said guide rollers and said support rollers, said bearing means being located solely outside of the maximum strand width.

3. The strand guide framework as defined in claim 1, wherein the supporting diameter of the support rollers approximately is in a range corresponding to the diameter of the guide rollers up to 1.6-fold diameter of the guide rollers.

4. The strand guide framework as defined in claim 3, further including bearing means for the guide rollers and bearing means for the support rollers, the bearing means for the guide rollers in contrast to the bearing means for the support rollers are floatingly arranged transverse to the direction of travel of the strand.

5. The strand guide framework as defined in claim 4, wherein the support collars of the support rollers are dished.

6. A strand guide framework for supporting a partially solidified strand in a continuous casting installation, comprising at least two guide roller pairs which successively follow one another in the direction of travel of the strand, support rollers provided for said guide rollers, the lengthwise axes of the support rollers being arranged with respect to the lengthwise axes of the guide rollers approximately in a plane located transverse to the direction of travel of the strand, the supporting diameter of the support rollers being approximately in a range corresponding to the diameter of the guide rollers up to 1.6-fold diameter of the guide rollers, and including bearing means for the guide rollers and bearing means for the guide rollers and bearing means for the support rollers, the bearing means for the guide rollers, in contrast to the bearing means for the support rollers, being floatingly arranged transverse to the direction of travel of the strand, said framework being equipped with secondary cooling means, each of the support rollers being provided with only two dished support collars for the associated guide roller, the two support collars of each support roller are located only between opposite ends of such support roller, the diameter of the support rollers determined by the permissible mechanical loading and the space required for the secondary cooling means determining the minimum spacing of the successive guide rollers, and wherein there is provided a spacing of the support collars, at which the maximum bending moment brought about in the guide roller at the region of the support collars by the widest strand corresponds to the maximum bending moment produced by a narrow strand at the roller center.

7. The strand guide framework as defined in claim 6, wherein a common axial plane of the guide roller pairs is shifted by a maximum spacing from a common axial plane of the support roller pairs opposite to the direction of travel of the strand, and wherein such spacing corresponds at the maximum to the tangent of 2° multiplied by the radius of the guide roller.

8. The strand guide framework as defined in claim 7, wherein swelling of the support rollers under load and thus the displacement of the guide rollers is maintained constant by accommodation of the moment of inertia of the support rollers to the ferrostatic intensity.

* * * * *